US006684048B2

(12) United States Patent
Caruthers et al.

(10) Patent No.: US 6,684,048 B2
(45) Date of Patent: Jan. 27, 2004

(54) IMAGE PREPARATION SYSTEM FOR TRANSFER TO SUBSTRATES

(75) Inventors: Edward B. Caruthers, Rochester, NY (US); Paul W. Morehouse, Jr., Webster, NY (US); Henry R. Till, East Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/046,149

(22) Filed: Jan. 16, 2002

(65) Prior Publication Data

US 2003/0133728 A1 Jul. 17, 2003

(51) Int. Cl.[7] ..... G03G 15/16
(52) U.S. Cl. ..... 399/296
(58) Field of Search ..... 399/45, 49, 57, 399/60, 237, 246, 296

(56) References Cited

U.S. PATENT DOCUMENTS 4,358,195 A 11/1982 Kuehnle et al. ..... 399/146
4,473,186 A * 9/1984 Alperin ..... 239/8
5,332,642 A 7/1994 Simms et al. ..... 430/125
5,558,970 A * 9/1996 Landa et al. ..... 430/126
5,627,632 A * 5/1997 Staudenmayer et al. .... 399/296
5,689,757 A * 11/1997 Ferrante et al. ..... 399/45
5,893,016 A * 4/1999 Landa et al. ..... 399/297
6,185,399 B1 * 2/2001 Zhao et al. ..... 399/223

OTHER PUBLICATIONS

E. Caruthers et al., "Effects of Paper Properties on Liquid Toner Transfer," IS&Ts NIP15: 1999, International Conference On Digital Printing Technologies, pp. 642–645.
E. Caruthers et al., "Reverse Roll Effects in Liquid Toner Electrophotography," IS&Ts Eight International Congress on Advances in Non–Impact Printing Technologies, 1992, pp. 206–208.

* cited by examiner

*Primary Examiner*—Hoan Tran
(74) *Attorney, Agent, or Firm*—Oliff & Berridge, PLC

(57) ABSTRACT

A system and method of applying a controlled amount of fluid to a moveable image carrying member of an electrographic printing system using a liquid toner before an image is transferred to a substrate. The amount of fluid applied may be controlled by a re-wet roller, located between the toner station and the transfer station, whose distance from the moveable image carrying member is varied along with the rotational speed and direction of the re-wet roller, according to either the roughness and porosity of the substrate or the print quality of the substrate. Alternatively, the fluid may be directly applied just to image areas of the moveable image carrying member to improve print quality.

29 Claims, 7 Drawing Sheets

IMAGE PREPARATION SYSTEM FOR TRANSFER TO SUBSTRATES

BACKGROUND OF THE INVENTION

1. Field of Invention

The invention relates to devices and methods for transferring an image formed using liquid image development to a receiving medium or an intermediate transfer member.

2. Description of the Related Art

A typical electrographic printing device, such as, for example, a photocopier, a laser printer, a facsimile machine or the like, employs a uniform electrostatically-charged surface of a photoreceptor. The surface of the photoreceptor is exposed to a light beam, which is modulated according to image data that is to be printed. Exposing the surface of the photoreceptor to the light beam selectively discharges the electrostatic charge to form a latent image of the image data. The latent image is then developed by bringing a developer into contact with the latent image on the surface of the photoreceptor. The developed image, now recorded on the surface of the photoreceptor, is transferred to a substrate, such as, paper, either directly or indirectly, through an intermediate transfer. After transfer, the developed image on the substrate may then be subjected to further processing to fuse or fix the developed image to the substrate.

As is well known in the art, a latent electrostatic image can also be produced by image-wise applying electrons or ions to a dielectric surface. While this invention will be described primarily in terms of electrophotographic printing devices using photoreceptors, uniform charging, and image wise light exposure, the methods and claims of this invention apply equally to electrographic printing devices using dielectrics and iconography or electrography.

Two types of developers are generally used in electrographic printing devices: a dry developer, comprising toner particles, and perhaps carrier granules to which the toner particles electrostatically adhere; and a liquid developer, comprising electrostatically-charged toner particles dispersed within a carrier fluid. This liquid developer is also called a liquid toner.

When transferring an image developed with liquid toner, that is, transferring a liquid toner image, from the surface of a photoreceptor or intermediate transfer member, such as, for example, a belt, to the substrate, the completeness of the transfer depends, in part, on the amount of fluid between the liquid toner image and the substrate. For example, if there is insufficient fluid to fill the gap between the liquid toner image and the substrate, then not all of the portions of the developed image will transfer to the substrate. This gap may be caused by air bubbles between the liquid toner image and the substrate, the roughness of the substrate and the like. The resulting developed areas of the substrate where the toner was not transferred are called microvoids. The microvoids are the small white spots sometimes seen within an otherwise developed area. The problem of microvoids is well know in the art. Their relation to paper properties has been described in "Effects of Paper Properties on Liquid Toner Transfer," by E. Caruthers et al., IS&Ts NIP 15:1999 International Conference on digital Printing Technologies, pages 642–645 (Caruthers 1), incorporated herein by reference in its entirety.

Effectively transferring all of the toner particles of a developed portion of the image to the surface of the substrate may require additional fluid to completely fill the gap between the surface of the photoreceptor and the surface of the substrate. When the substrate is rough, that is, when the surface of the substrate is characterized by microscopic peaks and valleys, to avoid microvoid formation, the thickness of the fluid layer on the surface of the photoreceptor should be adequate to assure sufficient liquid toner transfer to fill all the microscopic surfaces of the substrate. The roughness of the substrate surface may be measured by observation through a microscope, by optical interferometry, or by measuring the movements of a stylus dragged over the surface. Typical roughness values, which reflect the distances between peaks and valleys of the substrate, may range from several microns to tens of microns. If the substrate is porous, extra fluid must be provided to compensate for wicking, that is, fluid removed from the surface of the substrate by the capillary action of the pores of the substrate. The porosity of the substrate may be measured by air bleed through the substrate, in units of time per volume of air, or by the absorption rate of fluid into the substrate, in units of volume of fluid per unit of time.

Various methods have been used to supply the necessary amount of fluid for the image transfer process. For example, fluid may be applied by pre-wetting the surface of the substrate, as disclosed in U.S. Pat. No. 4,358,195 to Kuehnle et al. However, pre-wetting a porous substrate greatly increases the amount of fluid, e.g., carrier fluid, applied because the carrier fluid wicks into the substrate during the time period prior to the image transfer. Furthermore, if the developed image covers only a limited area of the substrate, then pre-wetting the entire surface of the substrate uses more fluid than is necessary to transfer the developed image. Complete transfer of the liquid toner image should occur before wicking removes too much fluid from the surface of the substrate, or microvoids will likely form.

When the liquid toner image is pressed between the surface of a moving photoreceptor, such as, the rotating surface of a photoreceptor drum, and the moving surface of a substrate at, for example, a roller image transfer station, fluid shear forces may be produced. These fluid shear forces may cause image smearing in the direction of photoreceptor motion, including toward the trailing edge of the moving substrate, especially if the developed image is not particularly cohesive. These shear forces are especially likely to cause smear if the substrate surface is smooth and/or non-absorbent. The problem of image smear is well known in the art. Its relation to paper properties is also described in Caruthers 1. To reduce this image smearing, developed images may be blotted or excess fluid may be removed by vacuum, such as provided in U.S. Pat. No. 5,332,642, which is incorporated herein by reference in its entirety. This blotting and fluid removal may compact the thickness of the developed image by removing excess carrier fluid and improve the cohesiveness of the liquid toner particles which form the developed image and reduce image smearing. However, removing too much carrier fluid could also increase the number of microvoids found within the transferred image.

SUMMARY OF THE INVENTION

This invention provides image forming methods and systems that apply a controlled amount of fluid to a movable image carrying member of an electrographic printing system that carries a developed liquid toner image before the developed liquid toner image is transferred to a substrate.

The amount of fluid applied may be based on the roughness and the porosity of a substrate onto which the developed liquid toner image is to be transferred. Re-wetting the developed liquid toner image on a photoreceptor instead of pre-wetting the substrate reduces the amount of re-wetting fluid, e.g., carrier fluid, that can wick into the substrate before transfer of the image to the substrate is complete. This reduces the total amount of fluid carried out of the system by the substrate and the amount of fluid which must be removed later by the fuser, and/or reclaimed and and/or returned to the toner supply.

The amount of fluid applied to the movable image carrying member may be controlled, for example, by a re-wet roller, located between a toner station and a transfer station. The re-wet roller may be movable closer to and farther from the moveable image carrying member. The rotational speed and direction of the re-wet roller can also be controlled. The image system may include a blotter/vacuum station between the toner station and the re-wet roller to remove fluid from the developed liquid toner image. The re-wet roller may be electrically charged to the same charge as the toner particles of the developed liquid toner image to repel toner particles from the re-wet roller. The action of the re-wet roller is generally similar to the action of a metering (or reverse) roller often included in the development system of a liquid toner printing device. Some effects on the final fluid layer thickness of roller-to-photoreceptor gap, process speed, and roll speed have been documented in the paper, "Reverse Roll Effects in Liquid Toner Electrophotography," by E. Caruthers et al., IS&T's Eighth International Congress on Advances in Non-Impact Printing Technologies (1992), pages 206-208 (Caruthers 2), incorporated herein by reference in its entirety.

The image forming systems according to this invention may also utilize observational inputs from a user on the print quality to predetermine the amount of fluid to apply to the image carrying member. Alternatively, or additionally, in various exemplary embodiments the user may input data to a controller about the substrate type, or about the roughness and porosity of the substrate to control the amount of fluid applied to the image carrying member. In various exemplary embodiments, the image forming systems may also operate automatically by obtaining roughness and porosity data from the substrate using sensors within the image forming system and use the measured data to control the amount of fluid applied to the image carrying member.

These and other features and advantages of this invention are described in, or are apparent from, the following detailed description of various exemplary embodiments of the systems and methods according to this invention.

BRIEF DESCRIPTION OF THE DRAWINGS

The exemplary embodiments of this invention will be described in detail, with reference to the following figures, wherein.

DETAILED DESCRIPTION OF EXEMPLARY EMBODIMENTS

Various exemplary embodiments of the systems and methods according to this invention will be described below primarily in terms of image preparation on the surface of a photoreceptor prior to transferring of the image to the final substrate. However, it should be clear that the systems and methods of this invention also apply to image preparation on any intermediate surface prior to transferring the image to the final substrate. Therefore, in various exemplary embodiments of the systems and methods according to this invention use printing devices that use intermediate transfer, such as transfer of four single color images to an intermediate belt or drum, followed by transferring the four color images to the final substrate.

Figure 1:
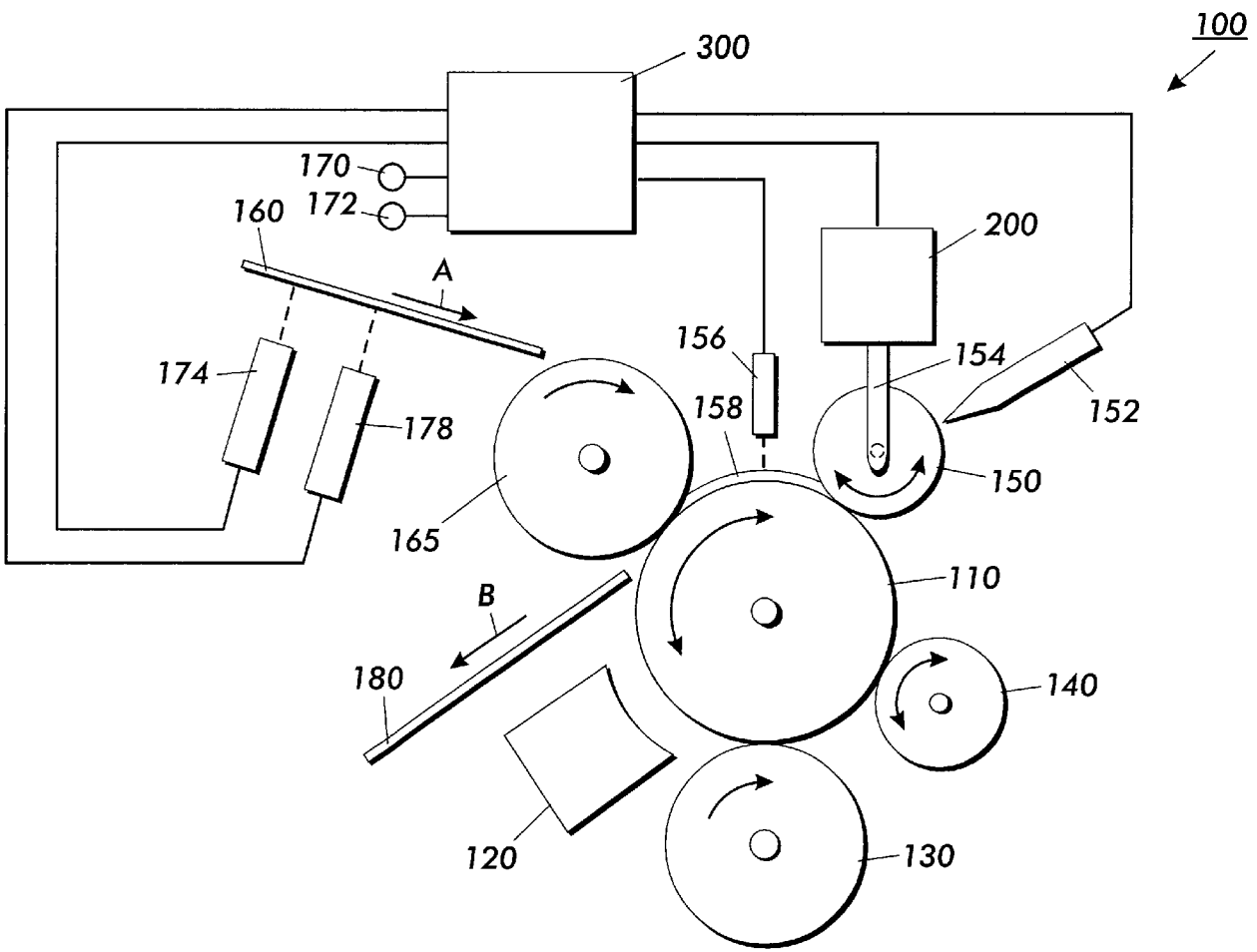
FIG. 1 is a schematic diagram of one exemplary embodiment of an image forming system having a re-wetting station according to this invention.

FIG. 1 is a block diagram of one exemplary embodiment of an image forming system 100 that re-wets a liquid toner image before image transfer. In operation, a surface of a photoreceptor 110 is electrically charged to a uniform electrical potential. A latent image is formed on the surface of the photoreceptor 110 by an exposing station 120. The exposing station 120 can expose the charged surface of the photoreceptor 110 using a light beam or an ion beam that is modulated to correspond to the image to be transferred. While a single photoreceptor drum is shown in FIG. 1 as the photoreceptor 110, the systems and methods according to this invention are equally useful with a belt-type imaging member or with multiple photoreceptor members transferring images to a substrate carried by a belt-type member, such as, for example, with tandem photoreceptors producing a multicolor image-on-image-type image.

Electrically-charged toner particles are carried in a carrier fluid that is applied by a toner applicator 130 to the surface of the photoreceptor 110, to develop the latent image into a developed liquid toner image. In various exemplary embodiments, the surface of the photoreceptor 110 then moves past a blotter/compressor roller 140, which is designed to compact the developed liquid toner image onto the surface by blotting and/or vacuum and to remove fluid from the developed liquid toner image. Alternatively, or additionally, when the blotter/compressor roller 140 is charged to a uniform potential of the same sign as that of the toner particles, the blotter/compressor roller 140 may further compress the liquid toner image by electrostatic forces.

In various exemplary embodiments, the surface of the photoreceptor 110 moves past a re-wet roller 150. The re-wet roller 150 re-wets the surface of the developed liquid toner image immediately before the liquid toner image is transferred to a substrate. In various exemplary embodiments, the re-wet roller 150 applies an amount of re-wet fluid to the surface of the photoreceptor 110, and thus to the surface of the developed liquid toner image carried by the photoreceptor 110, that is determined to be just sufficient to assure complete transfer of the developed liquid toner image from the photoreceptor or intermediate member to a substrate. The re-wet roller 150 applies a fluid that effectively increases the ability of toner particles forming the developed liquid image to move from the surface of the photoreceptor 110 to the surface of the substrate. In particular, the fluid applied by the re-wet roller 150 may be, but need not be, the same fluid as that used to form the carrier fluid used in the liquid toner.

In various exemplary embodiments, the re-wet fluid may be applied to the surface of the re-wet roller 150 by a fluid applicator 152. In various exemplary embodiments, the fluid applicator 152 is one or more of a slot coating applicator, a wire coating applicator, a pad, a brush, a sprayer or a jet type fluid ejection device, or any other known or later-developed device or system for controllably applying the re-wet fluid to the surface of the re-wet roller 150. The fluid applicator 152 may include an optional heater usable to change the temperature and thus, the viscosity, of the re-wet fluid.

Alternatively, the re-wet roller 150 can be replaced with a jet-type fluid ejection device that directly ejects the re-wet fluid onto the developed liquid toner image. Jet-type fluid ejection devices include, but are not limited to, thermal or piezoelectric ink jet printheads or the like that are supplied with the re-wet fluid. It should be appreciated that, in this case, the re-wet fluid could be applied to the surface of the photoreceptor 110 only on those areas where the toned portions of the developer liquid toner image occurs. In this way, the re-wet fluid can be provided only where it is needed. This is discussed in greater detail, below, with respect to FIG. 7.

In various exemplary embodiments, the surface of the re-wet roller 150 may be located at a determined distance from the surface of the photoreceptor drum 110. In various exemplary embodiments, this determined distance is typically about 25 to about 250 microns. The determined distance between the re-wet roller 150 and the surface of the photoreceptor 10 is achieved by an actuator system 200 that controls a roller arm 154 that moves the re-wet roller 150 closer to or farther from the surface of the photoreceptor 110. The re-wet roller 150 may rotate in the same direction of rotation as that of the photoreceptor 110. Alternatively, in reverse roll metering, the re-wet roller 150 rotates in a direction that is opposite to the direction of rotation of the photoreceptor 110.

In various exemplary embodiments, the re-wet roller 150 may be charged by an electrical potential that is the same as the charge of the toner particles. This tends to electrostatically push the toner particles toward the surface of the photoreceptor 110 and to reduce the likelihood that the toner particles will be washed away by the applied re-wet fluid or attracted to and carried away by the re-wet roller 150. A suitable level of re-wet roller potential depends on a number of factors, including toner particle size and charge and process speed. In general, the substrate charge potential on the surface of the re-wet roller 150 will be determined experimentally. The re-wet roller 150 may also, optionally, include a heater that changes the temperature, and thus, the viscosity, of the re-wet fluid.

In various exemplary embodiments, the ratio of the rotational speed of the re-wet roller 150 to the speed of the photoreceptor 110 can be adjusted to provide fine control over the thickness of fluid layer of the re-wet fluid 158 applied by the re-wet roller 150. For example, when a reverse roll metering re-wet system is used, the relations between process speed, reverse roller speed and the thickness of the applied fluid layer of the re-wet fluid 158 are similar to those shown in FIGS. 1 and 2 of Caruthers 2. That is, at low reverse roller speeds, the fluid layer thickness is large. The fluid layer thickness decreases rapidly as the reverse roller speed increases. For each process speed, there is a reverse roller speed, referred to herein as the "optimum speed", that provides the minimum fluid layer thickness. Above the optimum speed, the fluid layer thickness increases slowly as the reverse roller speed increases. This relationship breaks down at high reverse roller speeds, because the fluid application becomes turbulent and the applied fluid layer becomes non-uniform. The inventors have discovered that, in general, the fluid layer thickness is more easily controlled by reverse roller speeds that are above, rather than below, the optimum speed.

The minimum fluid layer thickness achieved by the optimum speed of the reverse-turning re-wet roller is a function of the distance or gap between the re-wet roller 150 and the surface of the photoreceptor 110, the viscosity and surface tension of the re-wet fluid 158, and the process velocity, i.e., the velocity of the surface of the photoreceptor. Over a useful range of parameters, the inventors have discovered that, in general, this relationship may be approximated as:

$$T=0.3\ g[1-e^{-12.8(\rho v/\sigma)}],$$

where:

T is the minimum thickness of the fluid layer of the re-wet fluid 158;

g is the current gap between the re-wet roller 150 and the surface of the photoreceptor 110;

ρ is the viscosity of the re-wet fluid;

v is the process velocity of the photoreceptor 110; and

σ is the surface tension of the re-wet fluid.

For example, ISOPAR L®, available from Exxon Corporation, has a viscosity ρ of 1.61 cP (centipoise) and a surface tension, σ, of 25.9 dynes/cm at 25° C. Thus, when ISOPAR L® is used as the re-wet fluid, and the surface of the photoreceptor moves at a process velocity v of 17 inches/second, and the re-wet roller 150 moves in the opposite rotational direction at 20 inches per second, for a relative process velocity of 37 inches per second, the thickness T for the ISOPAR L® is about 10% of the gap g.

Thus, for a particular fluid and process velocity, usually constant during image transfer, the fluid thickness T is proportional to the gap g. Alternatively, given a particular gap g, the fluid thickness may be increased by adjusting the reverse roller velocity. In other words, the relative process velocity can be adjusted to provide fine control over the amount of re-wet fluid applied to the developed liquid toner image on the surface of the photoreceptor 110. For example, by reducing the reverse roll speed, and thus reducing the relative process velocity, it is possible to increase the thickness of the fluid layer 158 by more than 8 times a minimum fluid thickness, $T_{min}$ obtained for a particular gap g, viscosity ρ, surface tension σ and that maximum relative process velocity. As another example, if the gap distance is about 100 microns and ISOPAR L® is used as the re-wet fluid, and the relative process velocity is 37 inches per second as given above, the fluid thickness T of ISOPAR L® would be about 10 microns. However, decreasing the reverse roller speed, i.e., the speed of the re-wet roller 150 in the reverse direction, can cause the thickness of the fluid layer of the re-wet fluid 158 to increase up to about 80 microns. Thus, a wide range of thickness of the re-wet fluid layer 158, from about 10 microns to about 80 microns for a gap of about 100 microns, may be obtained by adjusting the reverse re-wet applicator roller speed relative to the speed of the photoreceptor. This wide range of thickness of the fluid layer 158 may be applied to the surface of the photoreceptor 110, to ensure the transfer of the developed liquid toner image without significant microvoids to a variety of substrates of varying roughness and porosity.

The fluid layer thickness T may be further decreased for any given gap, process velocity, and reverse roller velocity by heating the fluid, which reduces the viscosity ρ of the re-wet fluid. For example, reducing the viscosity of ISOPAR L™ to 1.2 cP by heating reduces the minimum thickness of the fluid layer of the re-wet fluid 158 to approximately 7% of the thickness of the gap g between the surface of the photoreceptor 110 and the re-wet roller 150 for a given gap g. In practice, the distance or gap g between the re-wet roller 150 and photoreceptor 110 typically ranges from about 25 microns to about 250 microns.

In various exemplary embodiments, an optional fluid thickness sensor 156 may used to detect the thickness of the fluid layer of the re-wet fluid 158 applied to the surface of the photoreceptor drum 110 by the re-wet roller 150. In various exemplary embodiments, the fluid thickness sensor 156 may be an electrical sensor, an optical sensor, a force sensor, an acoustic sensor or any other type of sensor that senses the thickness of the fluid layer of the re-wet fluid by direct or indirect means and that is able to generate a signal having a characteristic that is representative of the sensed thickness.

It should be appreciated that the re-wet fluid 158 can have many compositions and can be either the same as, or different from, the carrier fluid used in the liquid toner being used to develop the latent image. Accordingly, any suitable carrier fluid typically used for liquid toners can be used as the re-wet fluid. In various exemplary embodiments, the re-wet fluid is a non-polar liquid, such as, for example, one of the ISOPAR® series, available from Exxon Corporation, or mineral oil, etc.

In various exemplary embodiments, a substrate onto which the developed image is transferred, such as paper, may be directed to a substrate transfer drum 165 by a guiding member 160 in the direction of arrow A shown in FIG. 1. While a substrate transfer member 165 is shown in FIG. 1, the systems and methods according to this invention are equally useful with a belt-type imaging member, and the pathway of the substrate may be guided by various members well known in the art, e.g., trays, chutes, rollers, blocks, etc. The substrate may be pressed between the substrate transfer member 165 and the photoreceptor 110 to transfer the liquid toner image to the substrate. Once the developed liquid toner image is transferred to the substrate, for example, the substrate may then be guided in the direction of arrow B to other sections of the image processing system by another guiding member 180. The surface of the photoreceptor 110 may then be cleaned by a cleaner member (not shown).

In various exemplary embodiments, data from a user 170, or data received from a porosity sensor 174, a roughness sensor 178, the fluid thickness sensor 156, the fluid applicator 152, and/or the re-wet roller 150, and/or a signal 172 indicative of the relative process velocity may be received by a control system 300. A user's input 170 may include an observation of microvoids or smearing in the printed image, the type and/or properties of substrate, porosity and roughness measures of the substrate, and type and/or properties of the re-wet fluid. The determination may be made by visual observation by a user, for example, or by a user's knowledge of typical roughness characteristics of a known substrate. When a roughness determination is made by a user, roughness values may be entered into the memory of the controller by a user. The controller may be programmed to contain roughness values for a number of known substrates, and may also have a range of values with a guide or comparison standard for the user to employ to select one or more roughness values after comparing a particular substrate with the standard or guide.

A roughness determination may also be made by using sensors coupled to the controller, as disclosed, infra. In this case, the controller may generate a range of roughness values which may be selected manually by a user, or the controller may select a roughness value itself based on the measured roughness of a particular substrate. Should a variety of substrates be employed inseriatum, the controller may select and change the roughness determination for every substrate, e.g., sheet of paper. The system's relative velocity, which depends in part upon the speed and direction of travel of the photoreceptor 110 and in part on the speed and direction of the re-wet roller 150, may be entered and/or stored in a memory 350 (see, FIG. 3), which may be part of the control system 300.

The porosity sensor 174 may measure the porosity of the substrate by air bleed measures, fluid absorption measures, or any other known of later-developed technique usable to measure porosity. As with the determination of surface roughness, surface porosity may be made by a user on an empirical basis, or the controller may user roughness and porosity sensors 178 and 174 coupled to the controller to automatically determine porosity of a substrate. Also, the controller may have porosities of known substrates in memory and indicate to a user which porosity is associated with a given substrate, so that the user may make a selection of porosity, and/or the controller may make a porosity determination for a particular substrate. the user may either select a substrate type, which has roughness and porosity information stored in the memory 350, or enter such roughness and porosity data based on experiments or reference values into the system via a digital transmission device connected to the input/output interface 330. If no roughness or porosity data is available, the user may adjust the fluid layer thickness by predetermined amounts according to user inputs of observed microvoids or smearing.

The roughness sensor 178 may measure substrate roughness by displacement or vibration measures as the substrate passes a sensor contact, or by any other known or later-developed technique usable to measure the surface roughness. The fluid sensor 156 may sense the thickness of the fluid layer 158 applied to the surface of the photoreceptor 110, as discussed above. The fluid applicator 152 may provide information about the amount of fluid applied, by volumetric, fluid flow or gravimetric measures, and about the temperature of the fluid. The re-wet roller 150 may also provide temperature information about the fluid.

As an alternative to a user observing the image quality defects, such as microvoids and smear, a sensor 190 may be positioned to sense the transferred image on the final substrate. The sensor 190 may be a conventional machine vision image capture device. The control system 300 compares the captured image to the corresponding input image and uses the differences to detect microvoids and smears. For example, the control system 300 can detect any microvoids in the captured image by detecting a loss of signal in solid areas of the captured image. Similarly, the control system 300 can detect smears e.g., by detecting excess signal behind image areas.

Figure 2:
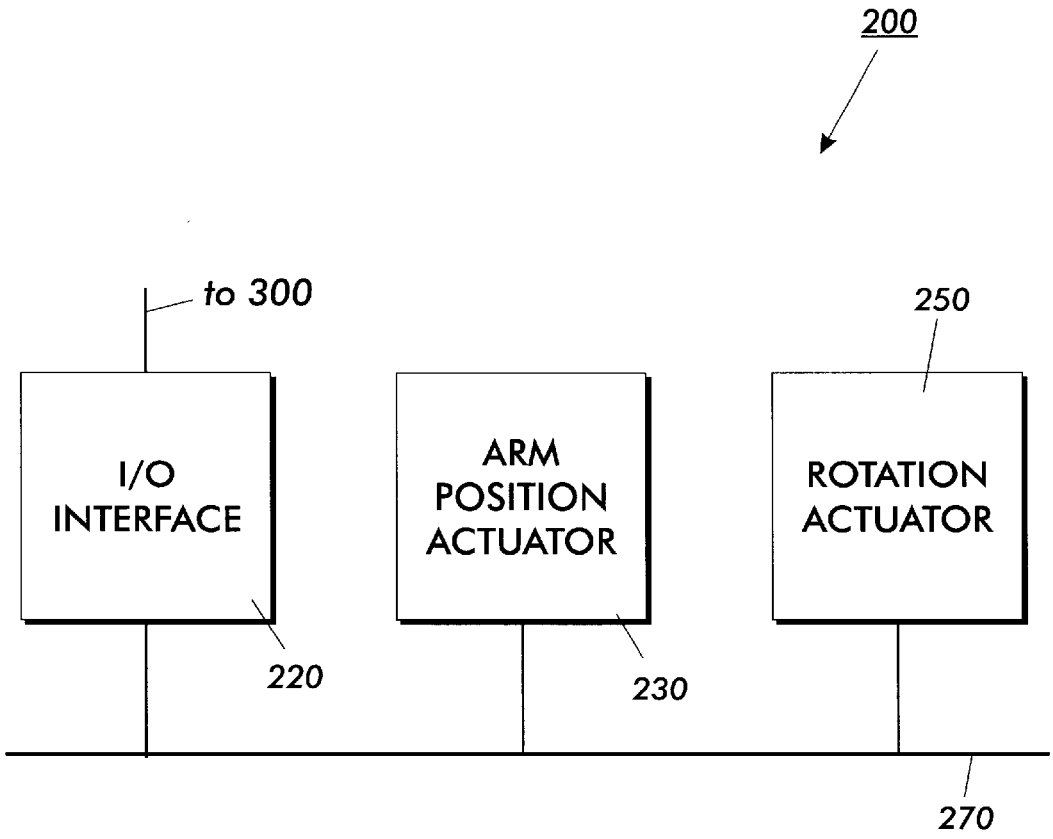
FIG. 2 is a functional block diagram of one exemplary embodiment of an actuator system according to this invention.

FIG. 2 shows a functional block diagram of one exemplary embodiment of the actuator system 200. The actuator system 200 has an input/output interface 220, an arm position indicator 230 and a rotation actuator 250. The input/output interface generally receives control information from the control system 300 for moving the roller arm 154, to which the re-wet roller 150 is connected, a predetermined distance closer to or farther from the surface of the photoreceptor 110. The position of the roller arm 154 and, thus, the re-wet roller 150 is controller by an arm position actuator 230. The arm position actuator 230 receives control signals received by the input/output interface 220 from the control system 300 via a signal bus 270. The roller arm 154 may be moved along an axis extending through the center of the photoreceptor 110 or at an angle to such a radial axis. In either case, the gap distance between the surface of the re-wet roller and the surface of the photoreceptor 110 are closest, may be determined by trigonometry. The rotation actuator 250 also receives control signals from the control system 300 via the input/output interface 220 via the signal bus 270. The rotation actuator 250 drives the re-wet roller 150 for speed and in the direction of rotation.

Figure 3:
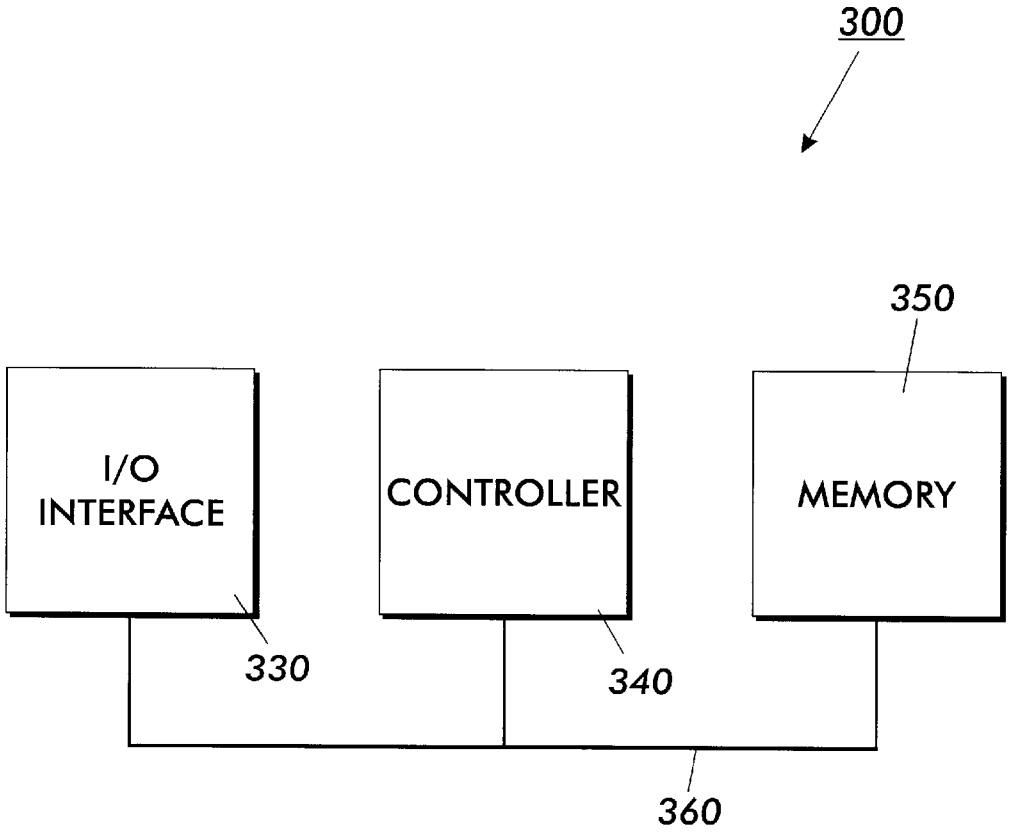
FIG. 3 is a functional block diagram of one exemplary embodiment of a controller system according to this invention.

FIG. 3 shows a function block diagram of one exemplary embodiment of the control system 300. As shown in FIG. 3, the control system 300 includes an input/output interface 330, a controller 340, memory 350 and a signal bus 360. The input/output interface 330 receives inputs from one or more of the user 170, the porosity sensor 174, the roughness sensor 178, the fluid sensor 156, the roller arm 154, the applicator 152, the re-wet roller 150 and the signal indicating the relative process velocity 172. The input/output interface 330 outputs control signals to the actuator system 200 to control the distance between the re-wet roller 150 and the surface of the photoreceptor 110 by moving the surface of the roller arm 154 to the rotation actuator 250 to control the direction and/or speed of rotation of the re-wet roller 150, and possibly to control a heater within the applicator 152 or the re-wet roller 150 to control the viscosity of the re-wet fluid.

The control system 300 may receive input from the user based on the user's observations of the printed image. If the user observes microvoids in the printed image, the user may input this observation to the control system 300, for example, by inputting a "Reduce Image Microvoids" command or an equivalent command or data through a keypad, keyboard, touch screen or any other known or later-developed digital transmission device connected to the input/output interface 330. The controller 340 may then retrieve from the memory 350 and/or determine from the sensor data provided by the attached sensors the distance of the re-wet roller 150 from the surface of the photoreceptor 110, the relative process velocity, and the viscosity of the re-wet fluid, the surface tension and the temperature of the fluid. These values may provide, by equation, through a look-up table, or any other known or later-developed technique, the thickness of the fluid layer for the current conditions of the image forming system 100. The controller 340 then sends control signals to the actuator system 200 to increase the fluid layer thickness by a determined amount to decrease the user-observed microvoids. The fluid layer thickness may be adjusted by changing the speed and/or the direction of the re-wet roller 150 by changing the speed of the photoreceptor 110, by increasing the distance between the re-wet roller 150 and the surface of the photoreceptor drum 110, or a combination of two or more of these factors.

Alternatively, the fluid layer thickness may be adjusted using a closed-loop system. In this case, the controller 340 retrieves the value of the existing fluid layer thickness from the fluid sensor 156 and may process this value in relation to that of the desired fluid layer thickness. A difference between the existing fluid layer thickness and the desired fluid layer thickness will result in a difference value. The controller 340 may use this difference value, if it exceeds a predetermined threshold, to provide a control signal 300 to increase or decrease the existing fluid layer thickness until it is substantially equal to the desired fluid layer thickness. This change in fluid thickness may be accomplished by sending one or more signals, based on the difference value signal, to change the speed of the photoreceptor 110 and/or the actuator system 200 to change the speed and direction of the re-wet roller 150, to change the distance between the re-wet roller 150 and the surface of the photoreceptor drum 110, to change the temperature of the re-wet fluid, or to change a combination of two or more of these factors. After effecting such a change, the controller 340 may again retrieve the value of the changed fluid layer thickness from the fluid sensor 156 and reiterate the process outlined above.

In various exemplary embodiments, the control system 300 includes a maximum re-wet roller speed to be used with the process speed and fluid. In general, in these exemplary embodiments, the control system 300 reduces or prevents increases in re-wet roller speed beyond the point at which the re-wet fluid is applied uniformly. The control system 300 may additionally signal the user of a problem should the maximum re-wet roller speed be used without sufficiently reducing the microvoids and/or smears.

If smearing of the image is detected by the user at the trailing edge of the printed image, the user may similarly input this observation to the control system 300 by a suitable command such as "Reduce Image Smearing", for example. If control sensor 190 detects image smear, control system 300 can use the signals generated by sensor 190 to reduce image smearing. In response, the control system 300 acts to reduce the fluid layer thickness to lessen the observed smearing. In this case, the controller 340 may adjust the blotter or the re-wet roller. In the latter case, the controller 340 may retrieve, from the memory 350 and/or determine from the sensor data provided by the attached sensors, one or more of the distance of re-wet roller 150 from the surface of the photoreceptor 110, i.e., the gap, the relative process velocity, and the viscosity, surface tension and temperature of the re-wet fluid. These values control the current thickness of the fluid layer. The controller 340 then sends control signals to the actuator system 200 and/or to the photoreceptor 110 to decrease the fluid layer thickness by a determined amount by changing the speed of the photoreceptor 110, by changing the speed and/or direction of the re-wet roller 150, by decreasing the distance between the re-wet roller 150 and the surface of the photoreceptor drum 110, or by changing a combination of two or more of these factors. Alternatively, the fluid layer thickness may be changed by a closed-loop system as described above.

If the control system 300 determines that image smear is present, and if the re-wet control system parameters are already at values that produce the minimum possible re-wet fluid layer thickness, then the control system 300 may disengage the re-wet system to eliminate image re-wet. Alternatively or in combination with eliminating image re-wet, the control system 300 may change parameters in the blotter roll system to reduce image layer wetness before the re-wet station. For example, increasing the blotter roll pressure can decrease image wetness. The right adjustments to the blotting and the re-wet systems are determined by the controller 340 using any convenient technique, such as, for example, look-up tables, algorithms, sets of rules comprising expert systems, or neutral nets.

The control system 300 may also receive a user input based on measured or reference values of the porosity and/or roughness of the substrate and/or the viscosity and/or surface tension of the re-wet fluid and enter these values in the memory 350 as those corresponding to a particular substrate or fluid. For example, the user may enter into the memory 350 via a keypad or other user input device connected to the input/output interface 330, the porosity and roughness values, and enter an identifier associated with these values. Similarly, values corresponding to a particular carrier fluid or other fluid applied by the re-wet roller 150 may also be entered into the memory 350 by the user along with an identifier of the fluid.

The control system 300 may also operate automatically to decrease microvoids and smearing of an image on a particular substrate. In this case, the controller 340 may receive inputs from the substrate porosity sensor 174 and the roughness sensor 176 that are usable to determine the fluid layer thickness to be applied. If a substrate's roughness is measured at 7 microns, for example, a fluid layer would need to be at least this thick to be sufficient to assure complete transfer of the liquid toner image to the substrate. If the substrate is porous, however, the thickness of the fluid applied must be increased by $$\Delta h=(dh/dt)*w/v,$$

where:

dh/dt is the rate of reduction of the fluid layer 158 thickness with time caused by the absorbing or wicking away of the developer fluid and/or re-wet fluid by the substrate.

w is the distance between the paper transfer point and the re-wet roller 150; and v is the process velocity of the photoreceptor.

Since w is fixed by the system design and v is generally constant over the time any portion of the substrate is on the contact zone, Δh is proportional to substrate porosity. The controller 340 may retrieve Δh values from the memory 350 based on experimentally derived equations or values stored in look-up tables for particular porosity values. The required total fluid layer 158 thickness will generally be the thickness required by the roughness of the substrate plus the thickness required by the porosity of the substrate.

Alternatively, the controller 340 can respond directly to the results of sensor 190, increasing re-wet when microvoids are detected and decreasing or disengaging re-wet when image smear is detected.

The controller 340 determines the re-wet fluid layer amount/thickness to be added to achieve a proper developed image based on the roughness of the substrate and the porosity of the substrate. If, for example, the substrate has extremely low porosity and is extremely smooth, which is found, for example, in glossy substrates or transparencies, the amount of re-wet liquid needed to be added may be below a minimum amount that can be added by re-wet applicator 150. In such situations, control 340 determines an amount of additional blotting or drying of the developed image on the photo receptor needs to be accomplished prior to application of re-wet fluid so that the amount of re-wet liquid added by the re-wet applicator will not cause smearing of the developed image upon transfer to the glossy substrate.

In most instances, the amount of re-wet fluid that is to be added to a developed image on the surface of photoreceptor 110 (or of an intermediate transfer medium of one is used) will be above a minimum amount and/or thickness that can be applied by re-wet applicator 150. In operation, control 340 sends control signals to the actuator system 200 to match a determined re-wet thickness by adjusting appropriate parameters of the re-wet applicator 150. These parameters include the re-wet roller speed and direction, the distance between the re-wet roller 150 and the surface of the photoreceptor 110, i.e., the gap, or by a combination of two or more of these factors. The re-wet fluid layer thickness may be changed by an open-loop and/or a closed-loop system, as indicated above.

Figure 4:
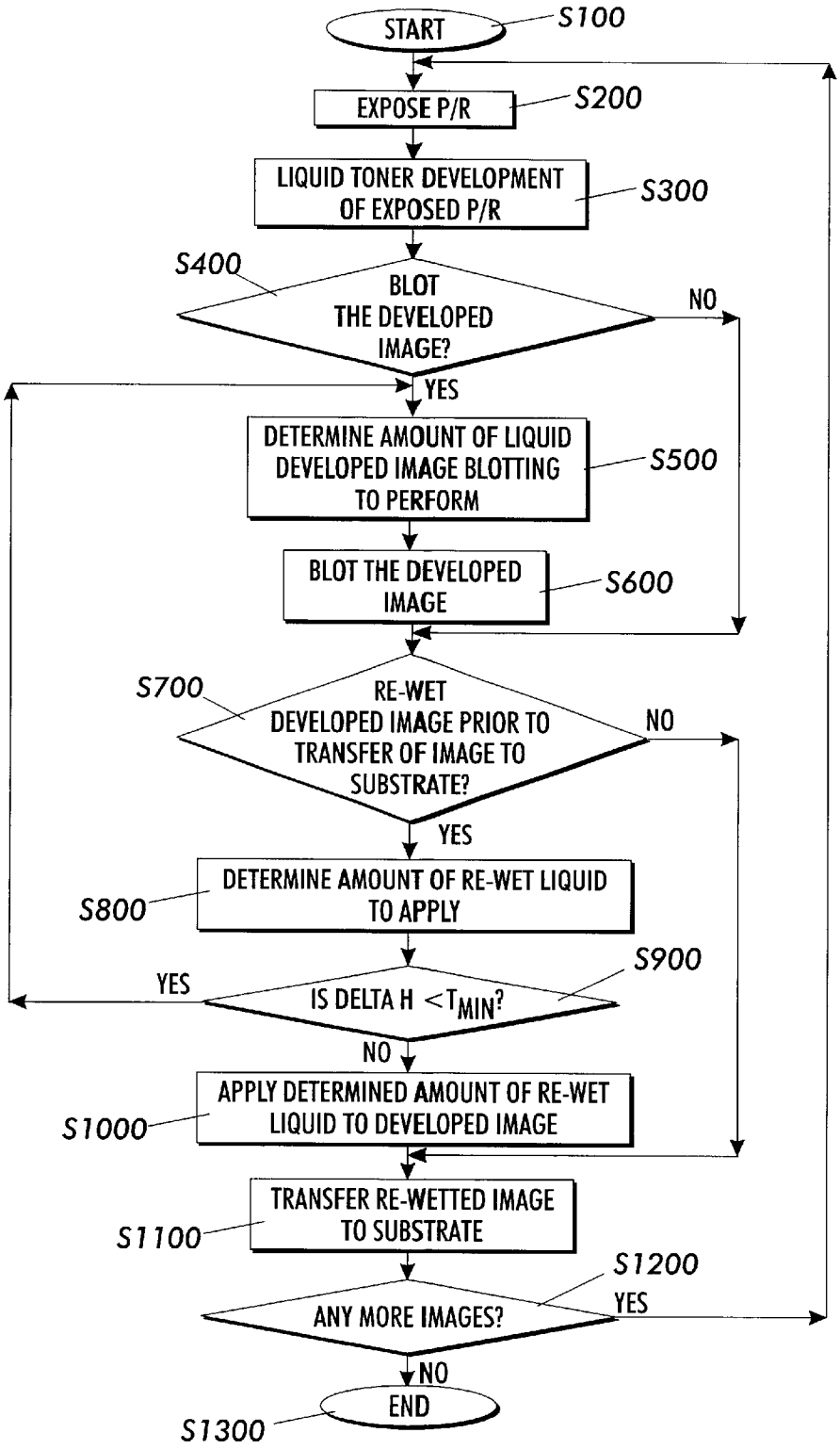
FIG. 4 is a flowchart outlining one exemplary embodiment of a method for forming an image according to this invention.

FIG. 4 is a flowchart outlining one exemplary embodiment of a method of re-wetting a liquid toner image before image transfer. Operation starts in step S100, and proceeds to step S200, where a latent image is formed on the photoreceptor. Then, in step S300, the latent image on the photoreceptor is developed by applying liquid toner to the latent image on the surface of photoreceptor. Next, in step S400, a determination is made whether to blot the developed image. Blotting is used to increase the compactness and cohesiveness of the toner particles which form the developed image and to remove fluid from both image and background areas of the photoreceptor. If a decision is made to blot the developed image, operation proceeds to step S500. In contrast, if blotting is not desired, operation jumps directly to step S700.

In step S500, the amount of toner liquid to be removed from the developed image is determined. The amount to be removed may be determined automatically by a user who visually monitors an image printed on a substrate. Next, in step S600, the blotter is activated to remove the determined amount of toner liquid and to compact the developed image. Operation then continues to step S700.

In step S700, a determination is made whether to re-wet the developed image on the surface of the photoreceptor prior to transfer of the developed image to a substrate. If not, operation jumps to step S1100. Otherwise, operation proceeds to step S800, where the amount and/or thickness of re-wet fluid to be applied to the developed image is determined. Then, in step S900, a determination is made whether the amount of re-wet liquid determined in step S800 is less than the minimum amount of re-wet liquid that can be applied by the re-wet applicator. If so, then operation jumps back to step S500 to re-determine how much blotting is needed. In this way, sufficient blotting is accomplished to permit the minimum amount of re-wet liquid that can be applied by the re-wet applicator to the developed image to be equal to or greater than the amount of re-wet liquid to apply to achieve a proper transferred image.

In step S1000, the re-wet applicator is activated to apply the determined amount of re-wet liquid to the developed image. Then, in step S1100, the re-wetted developed image is transferred from the photoreceptor to the substrate, either directly or indirectly via an intermediate transfer substrate. Next, in step S1200 a determination is made whether there are any more latent images to be formed on the surface of the photoreceptor. If so, operation returns to step S200. If not, operation continues to step S1300 where operation of the method ends.

It should be appreciated that the decision in step S900 can be skipped. In this case, the minimum amount of re-wet liquid will be applied in step S1000 if the determined amount is equal to or less than the minimum amount of re-wet liquid.

Figure 5:
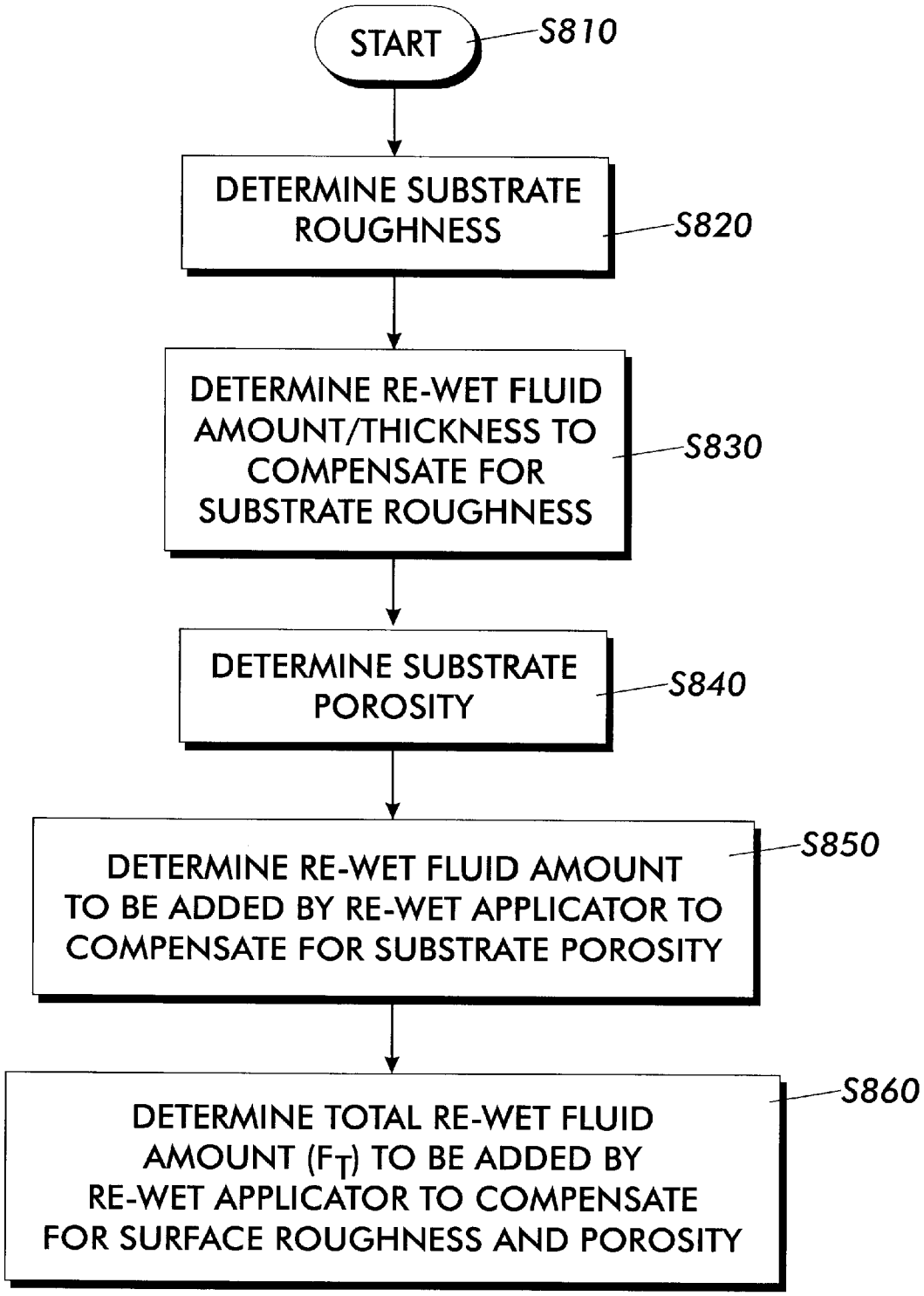
FIG. 5 is a flowchart outlining one exemplary embodiment of the method for determining the amount of re-wet fluid to apply to FIG. 4 according to this invention.

FIG. 5 is a flowchart outlining an exemplary embodiment of a method for determining the amount of re-wet fluid of step S800. Beginning in step S800, operation continues to step S810, where the substrate roughness is determined.

Then, in step S820, the re-wet fluid thickness and/or amount to be applied to compensate for the determined substrate roughness is determined. Next, in step S830, the substrate porosity is determined. Operation then continues to step S840.

In step S840, the re-wet fluid amount to be added to compensate for the determined substrate porosity is determined. Next, in step S850 the total amount and/or thickness of liquid to be added by a re-wet applicator due to surface roughness and porosity is determined. This may be a simple addition of the two amounts determined in step S820 and S840, or may be that amount altered by a factor which may be empirically determined for a given substrate. Operation then continues to step S860, where operation returns to step S900.

Figure 6:
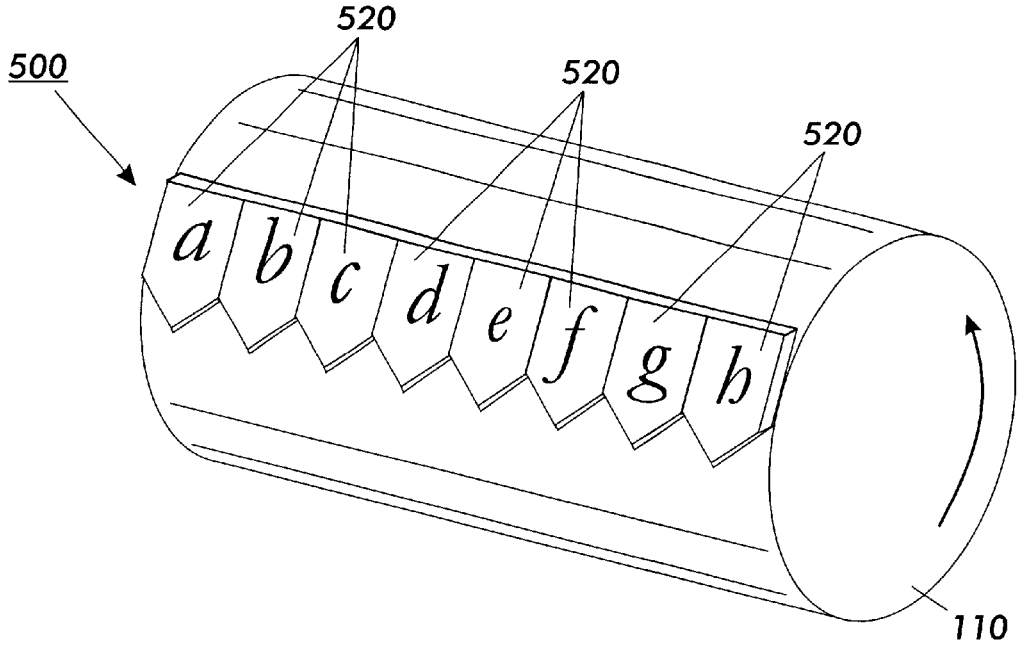
FIG. 6 is a block diagram of one exemplary embodiment of an array of fluid applicators according to this invention.

In various exemplary embodiments of the systems and methods of this invention, re-wetting by a liquid as opposed to re-wetting by a gas, a plasma or a solid is limited to image areas. In this case the background or untoned areas of the image are not re-wet. This may be accomplished by a full-width array of ink jet-like applicators 520 (*a–h*), as shown in FIG. 6, or comparable arrays of slot coating or wire coating applicators or any other type of applicators that may wet portions of the entire width of a drum or roller 510 in an array. This technique for wetting the re-wet roller 150 is advantageous because it reduces the amount of fluid that may have to be removed from the substrate and recycled, reused or disposed of. In this exemplary use, the control system 300 would also receive image information from the imaging system (not shown), allowing the controller 340 to control the application of fluid by each individual applicator in the full-width array to only those areas corresponding to the image. The thickness of the fluid layer to be applied in the image areas may be controlled by the fluid's viscosity, surface tension and temperature, the process velocity, the minimum gap, and the speed and direction of the re-wet roller 150, as outlined above.

Figure 7:
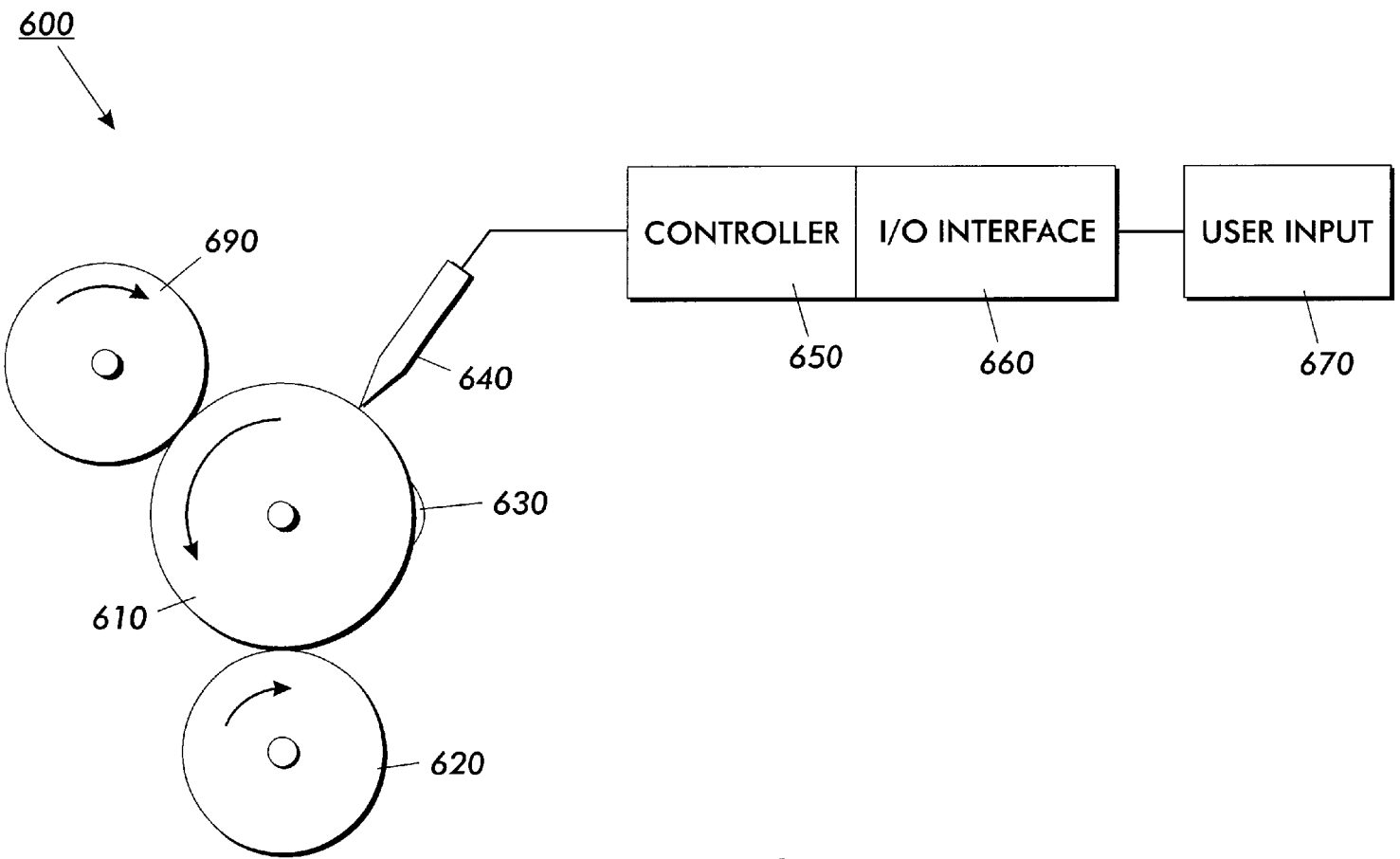
FIG. 7 is a functional block diagram of a second exemplary embodiment of an image forming system having a re-wetting station according to this invention.

As shown in FIG. 7, in various other exemplary embodiments of the systems and methods of this invention, the amount of fluid applied to the entire width of the photoreceptor member's surface 610 may be controlled by an input or successive inputs of the user in response to the observation of microvoids in the printed image. For example, after observing microvoids and/or smears in the printed image, the user may input a suitable command, such as "Reduce Image Microvoids" through a user's keypad, keyboard, touch screen or any other digital transmission device 670 connected to an input/output interface 660 for the controller 650. The controller 650 may send control signals to a fluid applicator 640, e.g., slot coating or wire coating applicators, rollers, sprayers, ink jet-like applicators, etc., to apply a small predetermined amount of fluid to the photoreceptor member's surface 610 corresponding to the area of the substrate. Thus, the amount of fluid applied to the liquid toner image may be increased to enhance the likelihood of complete image transfer to the substrate. The controller 650 may allow one such user input, i.e., one "Reduce Image Microvoids" key push, for sequential transfers of a single image to a substrate. Thus, a series of a single images may be printed, each image using an increased amount of applied fluid, in order to determine whether and by what degree the user's observation of microvoids may be decreased. Alternatively, the controller 650 may allow the user to initially apply multiples of a small predetermined amount of fluid to the photoreceptor member's surface. This exemplary system may also limit re-wetting by a fluid to liquid toner image areas 630, by a full-width array of ink jet-like applicators or comparable arrays of slot coating or wire coating applicators or any other type of applicators that may re-wet the entire width of the substrate in an array. The controller 650 would, in this case, also receive image information from the imaging system (not shown), allowing the controller 650 to control the application of a small amount of fluid by each individual applicator in the full-width array to those areas corresponding to the liquid toner image 630.

Alternatively, the controller 650 may use the image quality defect determination system employing the sensor 190 to determine additional amounts of re-wet liquid to apply to the surface of the photoreceptor.

The following examples illustrate specific embodiments of the present invention. One skilled in the art will recognize that the appropriate reagents, and component ratios/concentrations may be adjusted as necessary to achieve specific product characteristics. All parts and percentages are by weight unless otherwise indicated.

EXAMPLES

A conventional liquid toner development printer was modified to include a reverse re-wet roller supplied with fluid from a slot coater. The printer also included a vacuum assisted blotter, which was switched on for some tests and was switched off for other tests to blot or not blot the image between the development and transfer stages. The amount/thickness of fluid applied by the re-wet roller was varied by varying the roller speed, and amount of fluid transferred to paper is measured gravimetrically. Three various types of paper substrates were used in the printer, at various re-wet fluid coating levels and with or without image blotting. The three papers used include (1) Image Series LX with a porosity of 55 sec/100 cc of air and a surface roughness of 4 microns; (2) Xerox 4024 with a porosity of 19 sec/100 cc of air and a surface roughness of 7 microns; and Nekoosa Bond with a porosity of 21 sec/100 cc of air and a surface roughness of 8.5.

With respect to microvoid formation, the image was visually rated on a scale of 0 to 8, where 0 represents no visible microvoids in a 1 square inch area; 1 represents several microvoids in the 1 square inch area, but the image area may nonetheless be acceptable image quality for undemanding image applications; and 2–10 represent steadily decreasing image quality due to increasing microvoids.

| Paper | Developed Mass per Unit Area ($mg/cm^2$) | Blotted? | Re-wet fluid ($mg/cm^2$) | Microvoid Level (0 = good; 10 = bad) |
|---|---|---|---|---|
| Image Series LX | 0.13 | Yes | 0 | 2 |
| Image Series LX | 0.13–0.23 | No | 0 | 0–1 |
| Image Series LX | 0.13 | Yes | 0.88–1.7 | 0 |
| Xerox 4024 | 0.12–0.31 | Yes | 0 | 5–6 |
| Xerox 4024 | 0.12–0.31 | No | 0 | 1–2 |
| Xerox 4024 | 0.13 | Yes | 1.21–1.7 | 0 |
| Nekoosa Bond | 0.13 | No | 0 | 8 |
| Nekoosa Bond | 0.13 | Yes | 1.21 | 2 |
| Nekoosa Bond | 0.13 | Yes | 1.7 | 1 |
| Nekoosa Bond | 0.13 | Yes | 4.1 | 0 |

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative not limiting. Various changes may be made without departing from the spirit and scope of the invention.

What is claimed is:

1. An electrographic printing system comprising:

a movable image carrying member;

a developed liquid toner image on the image carrier member;

a transfer station for transferring the developed liquid toner image to a substrate; and a re-wet station that applies a controlled amount of a fluid to a surface of the developed image carried on the movable image carrying member.

wherein the amount of fluid applied to the movable image carrying member is determined based on the porosity of the substrate.

2. an electrographic printing system comprising:

a movable image carrying member;

a developed liquid toner image on the carrier member;

a transfer station for transferring the developed liquid toner image to a substrate; and a re-wet station that applies a controlled amount of a fluid to a surface of the developed image carried on the movable image carrying member.

wherein the re-wet station comprises an array of liquid ejectors that selectively applies the fluid to selected areas of the image carrying member.

3. The printing system of claim 2, wherein the re-wet station applies the fluid to the image carrying member over imaged areas but not over non-imaged areas.

4. The printing system of claim 2, wherein the re-wet station comprises a heater that supplies heat to the fluid to alter viscosity of the fluid.

5. The printing system of claim 2, further comprising:

a controller system that controls each of the array of liquid ejectors corresponding to digitized image received by the controller and a position of each fluid applicator in relation to the liquid toner image.

6. An electrographic printing system comprising:

a movable image carrying member;

a developed liquid toner image on the image carrier member;

a transfer station for transferring the developed liquid toner image to a substrate;

a re-wet station that applies a controlled amount of a fluid to a surface of the developed liquid toner image carried on the movable image carrying member.

a fluid layer thickness sensor positioned to sense a fluid thickness on the movable image carrying member; and a control system that sends control signals to the re-wet station based on values received from the fluid layer thickness sensor.

7. The printing system of claim 6, wherein the re-wet station is located between a toner station and the transfer station in the printing system.

8. The printing system of claim 1, wherein the re-wet station comprises a re-wet roller that applies the fluid to the image carrying member.

9. The printing system of claim 6, wherein:

the re-wet station comprises a re-wet roller; and a roller arm connected to the re-wet roller, the printing system further comprises an actuator system that moves the roller arm to control a distance of the re-wet roller from the movable image carrying member.

10. The printing system of claim 9, wherein the actuator system comprises a drive circuit that controllably drives the re-wet roller at at least one of a desired rotational speed and a desired direction.

11. An electrographic printing system comprising:

a movable image carrying member;

a developed liquid toner image on the image carrier member;

a transfer station for transferring the developed liquid toner image to a substrate;

a re-wet station that applies a controlled amount of a fluid to a surface of the developed image carried on the movable image carrying member; and a control system that generates control signals and adjusts the control signals to the re-wet station based on a process velocity of the image carrying member relative to the re-wet station.

12. An electrographic printing system comprising:

a movable image carrying member;

a developed liquid toner image on the image carrier member;

a transfer station for transferring the developed liquid toner image to a substrate;

a re-wet station that applies a controlled amount of a fluid to a surface of the developed image carried on the movable image carrying member;

a substrate roughness sensor that senses a surface roughness of the substrate; and a control system the receives signals from the substrate roughness sensor and generates control signals and adjusts the control signals to the re-wet station based on the sensed surface roughness.

13. An electrographic printing system comprising:

a movable image carrying member;

a developed liquid toner image on the image carrier member;

a transfer station for transferring the developed liquid toner image to a substrate; and a re-wet station comprising a re-wet roller that applies a controlled amount of a fluid surface of the developed image carried on the movable image carrying member;

wherein the re-wet roller is biased with an electrical charge sufficient to repel electrically charged toner particles in the liquid toner image.

14. An electrographic printing system comprising:

a movable image carrying member;

a developed liquid toner image on the image carrier member;

a transfer station for transferring the developed liquid toner image to a substrate;

a re-wet station that applies a controlled amount of a fluid to surface of the developed image carried on the movable image carrying member; and a blotter station that blots fluid from the liquid toner image and removes the fluid, whrein the blotter is located between a toner station and re-wet station.

15. The printing system of claim 14, wherein the amount of fluid applied to the movable image carrying member is based on a use's observation of microvoids within or smearing of the transferred liquid toner image on the substrate.

16. The printing system of claim 14, further comprising:

a control system; and an image sensor that senses image smear in the toner image after transfer to the substrate and delivers these signals to the control system that generates control signals and adjusts the control signals to the blotter station to change blotting in response to the signals from the image sensor.

17. An electrographic printing system comprising:

a movable image carrying member;

a developed liquid toner image on the image carrier member;

a transfer station for transferring the developed liquid toner image to a substrate;

a re-wet station that applies a controlled amount of a fluid to surface of the developed image carried on the movable image carrying member;

an image sensor that senses microvoids in the toner image after transfer to the substrate and delivers these signals to the control system; and a control system that generates control signals and adjusts the control signals to the re-wet station to change re-wet in response to the signals from the image sensor.

18. The printing system of claim 17 wherein the image carrying member is a photoreceptor.

19. The printing system of claim 17 wherein the image carrying member is a dielectric and the image is produced using one or more ion or electron sources.

20. The printing system of claim 17 wherein the image carrying member is an intermediate transfer member.

21. An electrographic printing system comprising:

a movable image carrying member;

a developed liquid toner image on the image carrier member;

a transfer station for transferring the developed liquid toner image to a substrate;

a re-wet station that applies a controlled amount of a fluid to surface of the developed image carried on the movable image carrying member;

a substrate porosity sensor, and a control system that receives signals from the substrate porosity sensor and generates control signals and adjusts the control signals to the re-wet station based on the sensed substrate porosity.

22. A method of printing an image using a liquid toner, comprising:

forming a latent image on an image carrying member;

developing the latent image with a liquid toner to form a liquid toner image on the image carrying member;

re-wetting the liquid toner image with a re-wet fluid; and transferring the liquid toner image to a substrate;

wherein the re-wet fluid applied is in an amount based on at least one of a porosity of the substrate and an identity of a particular substrate.

23. The method of claim 22, further comprising blotting the toner image to increase image cohesion and decrease image wetness prior to image re-wet.

24. The method of claim 23, wherein the blotting is based on a user's observation of smearing of the transferred liquid toner image on the substrate.

25. The method of claim 23, wherein the blotting is based on an image sensor that senses smearing in the toner image after transfer to the substrate.

26. The method of claim 22, wherein the re-wetting step comprises applying a controlled amount of the fluid to the developed liquid toner image.

27. A method of printing an image using a liquid toner, comprising:

forming a latent image on an image carrying member;

developing the latent image with a liquid toner to form a liquid toner image on the image carrying member;

re-wetting the liquid toner image with a re-wet fluid; and transferring the liquid toner image to a substrate;

wherein the re-wet fluid applied is in an amount based on a user's observation of microvoids within the transferred liquid toner image on the substrate.

28. A method of printing an image using a liquid toner, comprising:

forming a latent image on an image carrying member;

developing the latent image with a liquid toner to form a liquid toner image on the image carrying member;

re-wetting the liquid toner image with a re-wet fluid; and transferring the liquid toner image to a substrate;

wherein the re-wet fluid applied is in an amount based on an image sensor that senses microvoids in the toner image after transfer to the substrate.

29. A method of printing an image using a liquid toner, comprising:

determining the surface roughness of an image forming substrate;

determining the amount of re-wet fluid thickness to compensate for surface roughness;

determining substrate porosity;

determining re-wet fluid amount to be added by a re-wet applicator to compensate for substrate porosity;

determining a total re-wet fluid amount to be added by re-wet applicator to compensate for surface roughness and porosity; and.

applying the determined total re-wet fluid amount to the image forming substrate.

* * * * *